United States Patent [19]

Takami

[11] 4,206,854

[45] Jun. 10, 1980

[54] DISPOSABLE PLASTIC UPPER LID

[75] Inventor: Yasushi Takami, Sayama, Japan

[73] Assignee: Myojo Foods Co., Ltd., Tokyo, Japan

[21] Appl. No.: 962,897

[22] Filed: Nov. 22, 1978

[51] Int. Cl.[2] ..... B65D 51/16; B65D 21/02

[52] U.S. Cl. ..... 222/478; 206/504; 206/508; 220/355; 220/366; 220/374; 222/567

[58] Field of Search ..... 220/374, 355, 366; 222/478, 544, 566, 567; 206/508, 504, 519, 520

[56] References Cited

U.S. PATENT DOCUMENTS

| | | | |
|---|---|---|---|
| 3,362,565 | 1/1968 | McCormick | 220/366 |
| 3,419,184 | 12/1968 | Asenbauer | 220/355 |
| 3,632,016 | 1/1972 | Bozek | 220/355 |
| 3,915,355 | 10/1975 | Young | 220/366 |
| 3,989,142 | 11/1976 | Gwilliam | 220/374 |

*Primary Examiner*—George E. Lowrance
*Attorney, Agent, or Firm*—Oblon, Fisher, Spivak, McClelland & Maier

[57] ABSTRACT

A disposable plastic upper lid adapted for frictional mounting upon the rim of a container of a quick-cooking food has an annular horizontal member which is provided thereon with a lid holding ridged portion which is composed of saw-toothed ridges and, if desired, provided with a plurality of anti-stacking notches in a random arrangement along the outer or inner periphery of the horizontal member.

4 Claims, 3 Drawing Figures

DISPOSABLE PLASTIC UPPER LID

BACKGROUND OF THE INVENTION

1. Field of the Invention

This invention relates to a disposable plastic upper lid or closure for frictional mounting upon the rim of a container for containing and cooking quick-cooking foods.

2. Description of the Prior Art

With the quick-cooking foods which are popular these days the container is filled with boiling water and left to stand until the food in the container is made edible and then the water is discarded before eating the food.

Examples of quick-cooking foods of this type include quick-cooking Chinese noodles, quick-cooking chow mein, quick-cooking rice, etc. With, for example, quick-cooking Chinese noodles, the dried noodles are first made edible with boiling water. The water is then discarded, and the container is again filled with boiling water, in which is then dissolved the accompanying powdered soup. Many types of cups or food tubs have been invented for containing and cooking such foods. They feature a container made of heat-insulating foamed styrene or of two walls between which air is filled so that no intense heat is felt by the user who holds it. However, no satisfactory heat insulating means have been devised for the upper lid or clousure which is to be frictionally mounted on the rim of the container. Therefore, when the user wishes to discard hot water by holding a person's upper lid, the heat of the water is directly transmitted to the finger that holds the lid, which sometimes causes a burn.

As shown in FIG. 3 of the appended drawings (as hereinafter defined), Japanese Utility Model Public Disclosure No. 33103/76 discloses a lid member 20 having disposed thereon a frictional mounting peripheral flange 22, a drain port 24 and an elevation 26 from the bottom panel 28 of the lid 20 for receiving the tip of a finger to hold the lid while hot water in which the contents of the container were cooked is being discarded. But since the elevation 24 has a flat surface, it is not capable of repressing or reducing the intensity of heat being transmitted to a person's finger that holds the lid.

SUMMARY OF THE INVENTION

It is therefore the object of this invention to provide an upper lid adapted for frictional mounting on the rim of a container which minimizes the transmission of heat to a person's finger which holds it while hot water used for cooking the contents of the cup is being discarded.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
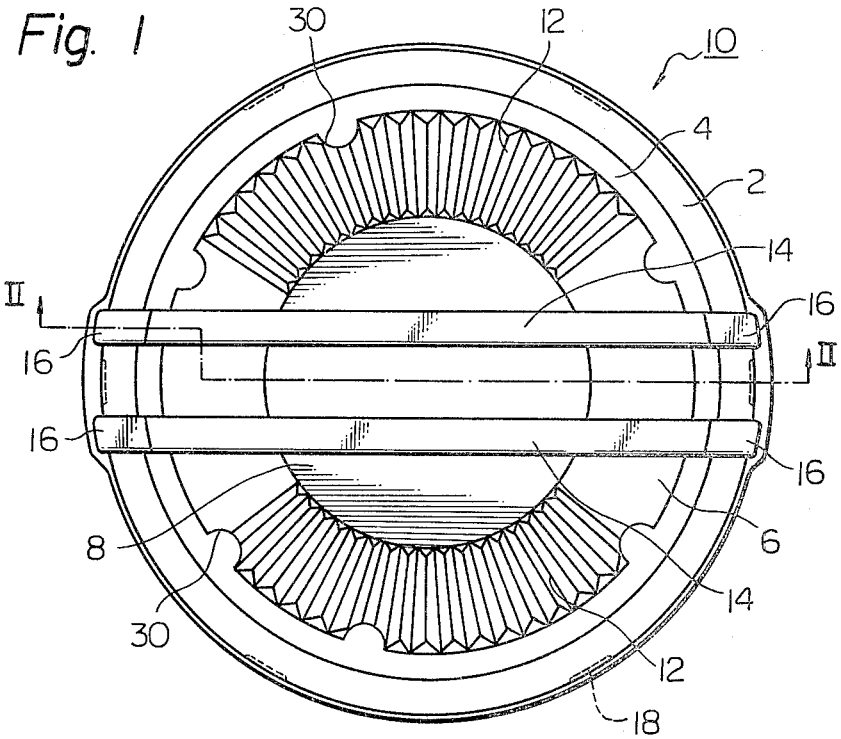
FIG. 1 is a plan view of an upper lid according to this invention.
Figure 2:
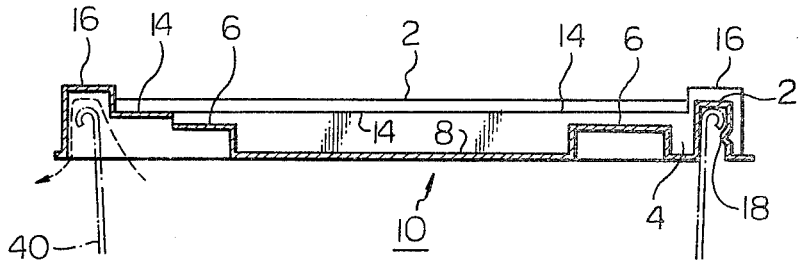
FIG. 2 is a cross-sectional view of FIG. 1 taken along the line II—II.
Figure 3:
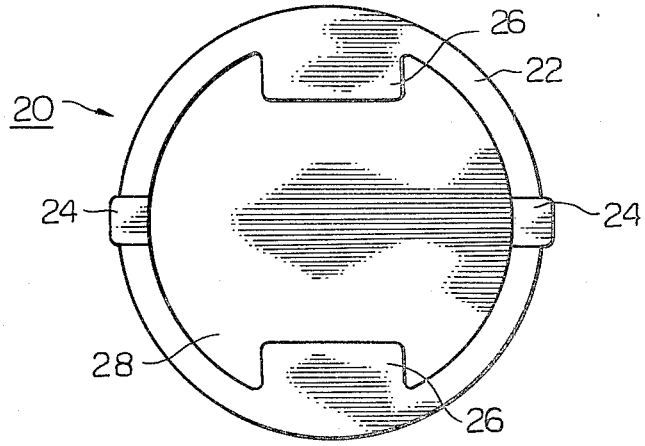
Fig. 3 PRIOR ART
FIG. 3 is a plan view of an upper lid of the prior art.

In the accompanying drawing, as FIGS. 1 and 2 show, an upper lid 10 according to this invention has disposed thereon a frictional mounting peripheral flange 2 having a side wall of a given height and an annular groove 4 adjacent the flange 2. The flange 2 is frictionally mounted on the rim of the container so as to cover it. An annular horizontal member 6 in doughnut form is disposed at a level lower than the flange 2 between the annular groove 4 and a circular recess 8 of a given radius disposed the center of the lid. The horizontal member 6 is elevated from the circular recess 8. On the annular horizontal member 6 are disposed a first and second lid holding ridged portion 12 each having a saw-toothed cross section and by which fingers may hold the lid.

It is preferred that the ridged portions 12 be disposed on the member 6 to occupy a substantially sectorial part of the member in such a manner that the ridgeline of each ridge points to the center of the lid. The number and height of the saw-toothed ridges may vary depending on the case. The annular horizontal member 6 is provided with at least one lid holding ridged portion, preferably two such portions in a symmetrical configuration with respect to the center of the lid.

Reinforcement ribs 14 that diametrically cross the flange 2 are disposed transversely to the annular horizontal member 6 but avoid the sector comprising saw-toothed ridges. A liquid drain port 16 is disposed where each rib contacts the flange 2. The drain port 16 has a side wall a little higher than that of the flange 2 and extends beyond the outer periphery of the flange. At least two drain ports are disposed symmetrically with respect to the center of the lid such that while liquid comes out of one drain port, air comes into the other port to help discharge of the liquid.

If units of the upper lid of this invention are stored by several tens or several hundreds or sometimes by several thousands, two or more units may stick to each other so closely that they cannot easily be separated (a phenomenon often called "stacking" or "sticking"). To avioid this phenomenon, a plurality of notches 30 are disposed along the outer or inner periphery of the annular horizontal member 6. The anti-stacking notches 30 are preferably disposed in a random arrangement rather than a symmetrical or regular arrangement in order to minimize the chance of one notch coinciding with another. Such random arrangement of anti-stacking notches 30 can be achieved by using a number of dies having different arrangements of notches. To be more specific, molding, for example, vacuum molding or the like, of a synthetic resin sheet placed over an array of these dies provides as many upper lids of different arrangements of anti-stacking notches as there are dies.

In FIG. 2, the body of the container is shown by the dot-dash line as it is frictionally engaged with the upper lid of this invention. A frictional mounting rib 18 may be disposed on the outer periphery of the flange 2 to provide desired mounting strength between the upper lid 10 and the body of the container 40.

The lids of the present invention are made of thermoplastic material, such as, for example, polyethylene, polystylene, polypropylene, etc.

In addition to the circular form as shown in FIGS. 1 and 2, the lid according to the present invention may be square or other suitable form, if desired.

Referring to FIG. 2, liquid in the container is discharged outside from the drain port 16 along the path shown by the dotted line and the arrow. While the container is being emptied of the liquid, transmission of the heat of liquid to a person's fingers that hold the upper lid is minimized because they contact only the saw-toothed ridges that comprise the lid holding sector. Therefore, even if the container is filled with boiling water exceeds the level of the bottom of the annular horizontal member or even if the container is tilted until the boiling water within contacts the bottom of the annular horizontal member, substantially no heat is transmitted to the fingers. This means the user can safely discard unwanted hot water outside of the container.

As a further advantage of this invention, the anti-stacking notches provided on the annular horizontal member 6 assure correct mounting of the upper lid on the rim of the container in the manufacture of quick-cooking foods. In other words, random arrangement of the anti-stacking notches eliminates the chance of one lid engaging with and sticking to another during storage of many units of upper lid.

While certain representative embodiments and details have been shown for the purpose of illustrating the invention, it will be apparent to those skilled in the art that various changes and modifications may be made therein without departing from the spirit or scope of the invention.

What is claimed as new and desired to be secured by Letters Patent of the United States is:

1. A disposable plastic upper lid to be frictionally mounted on the rim of a container of a quick-cooking food comprising:

a frictional mounting peripheral, U-shaped flange having a given height, an annular groove disposed along the inner periphery of the flange, at least one reinforcing rib that crosses the upper lid parallel to the diameter of said upper lid and connects with said flange, a port formed by said at least one rib for draining the container of liquid in such a manner that said at least one rib extends beyond the flange, an annular horizontal member disposed along the inner periphery of the annular groove of an doughnut form, and a ridged portion comprising saw-toothed ridges occupying that area of the annular horizontal member which is free of the at least one reinforcing rib.

2. The upper lid as set forth in claim 1 the horizontal member further comprising: a plurality of anti-stacking notches in a random arrangement along the outer or inner periphery of the horizontal member.

3. The upper lid as set forth in claim 1 or 2 wherein said lid is substantially circular.

4. The upper lid as set forth in claim 1 wherein said at least one rib comprises two parallel ribs symmetrically disposed along the diameter of said upper lid.

* * * * *